US008674895B2

(12) United States Patent
Timofeev

(10) Patent No.: US 8,674,895 B2
(45) Date of Patent: Mar. 18, 2014

(54) MULTIBAND ANTENNA

(75) Inventor: Igor Timofeev, Dallas, TX (US)

(73) Assignee: Andrew LLC, Hickory, NC (US)

( * ) Notice: Subject to any disclaimer, the term of this patent is extended or adjusted under 35 U.S.C. 154(b) by 349 days.

(21) Appl. No.: 13/099,550

(22) Filed: May 3, 2011

(65) Prior Publication Data

US 2012/0280878 A1 Nov. 8, 2012

(51) Int. Cl.
*H01Q 9/16* (2006.01)

(52) U.S. Cl.
USPC ..... 343/793; 343/795

(58) Field of Classification Search
USPC ..... 343/793, 795, 769, 835
See application file for complete search history.

(56) References Cited

U.S. PATENT DOCUMENTS

| | | | | |
|---|---|---|---|---|
| 7,173,572 | B2 | 2/2007 | Teillet et al. | |
| 7,924,230 | B2 * | 4/2011 | Hung et al. | 343/702 |
| 2003/0210206 | A1 * | 11/2003 | Phillips et al. | 343/895 |
| 2010/0053008 | A1 * | 3/2010 | Le et al. | 343/745 |
| 2012/0100817 | A1 * | 4/2012 | Schachar et al. | 455/73 |
| 2012/0218162 | A1 * | 8/2012 | Aoki et al. | 343/835 |

FOREIGN PATENT DOCUMENTS

| | | |
|---|---|---|
| EP | 1 227 545 A1 | 7/2002 |
| EP | 1 353 405 A1 | 10/2003 |
| WO | WO 03/041289 | 5/2003 |
| WO | WO 2010/063007 | 6/2010 |

OTHER PUBLICATIONS

European Search Report for related European No. EP 12 16 6519 dated Aug. 2, 2012.

* cited by examiner

*Primary Examiner* — Ahshik Kim
(74) *Attorney, Agent, or Firm* — Husch Blackwell LLP

(57) ABSTRACT

A multiband antenna is provided having a longitudinal ground plane and several linear arrays of radiating elements mounted on the ground plane. A first set of first radiating elements may be disposed lengthwise along a center of the ground plane. The first radiating elements may be dimensioned to operate in a first frequency band, such a frequency range of about 790-960 MHz. A second set of second radiating elements may also be disposed lengthwise along the center of the ground plane. The second radiating elements may be dimensioned to operate in a second frequency band, such as a frequency range of about 1710-2170 MHz. A third set of third radiating elements is disposed lengthwise on the ground plane on a first side of the first and second sets of radiating elements. The third radiating elements may be dimensioned to operate at a third frequency band, such as about 2.5-2.7 GHz and/or 3.4-3.8 GHz. The fourth set of fourth radiating elements is disposed lengthwise on the ground plane on a second side of the first and second sets of radiating elements. The fourth radiating elements are dimensioned to operate in the same frequency band as the third radiating elements.

26 Claims, 10 Drawing Sheets

70

MULTIBAND ANTENNA

BACKGROUND

Dual band antennas for wireless voice and data communications are known. For example, common frequency bands for GSM services include GSM900 and GSM1800. GSM900 operates at 880 -960 MHz. Hereinafter, this set of frequencies will be referred to as the "Band 1". GSM1800 operates in the frequency range of 1710 -1880 MHZ. Hereinafter, this set of frequencies will be referred to as the "Band 2".

Antennas for communications in these bands of frequencies typically include an array of radiating elements connected by a feed network. For efficient transmission and reception of Radio Frequency (RF) signals, the dimensions of radiating elements are typically matched to the wavelength of the intended band of operation. Because the wavelength of the 900 MHz band is longer than the wavelength of the 1800 MHz band, the radiating elements for one band are typically not used for the other band. In this regard, dual band antennas have been developed which include different radiating elements for the two bands. See, for example, U.S. Pat. No. 6,295,028, U.S. Pat. No. 6,333,720, U.S. Pat. No. 7,238,101 and U.S. Pat. No. 7,405,710 the disclosures of which are incorporated by reference.

In these known dual band antennas, the radiating elements of the Band 2 may be interspersed with radiating elements of the Band 1, or nested within the radiating elements of the 900 MHz band, or a combination of nesting and interspersing. See, e.g., U.S. Pat. 7,283,101, FIG. 12; U.S. Pat. No. 7,405,710, FIG. 1, FIG. 7. In these known dual-band antennas, the radiating elements are typically aligned along a single axis. This is done to minimize any increase in the width of the antenna when going from a single band to a dual band antenna.

An increase in antenna width may have several undesirable drawbacks. For example, a wider antenna may not fit in an existing location or, if it may physically be mounted to an existing tower, the tower may not have been designed to accommodate the extra wind loading of a wider antenna. The replacement of a tower structure is an expense that cellular communications network operators would prefer to avoid when upgrading from a single band antenna to a dual band antenna. Also, zoning regulations can prevent of using bigger antennas in some areas.

Known dual band antennas, while useful, are not sufficient to accommodate future traffic demands. Wireless data traffic is growing dramatically in various global markets. There are growing number of data service subscribers and increased traffic per subscriber. This is due, at least in part, to the growing popularity of "smart phones," such as the iPhone, Android-based devices, and wireless modems. The increasing demand of wireless data is exceeding the capacity of the traditional two-band wireless communications networks.

To address this increasing demand, wireless network operators are adding new wireless bands of frequencies. For example, the UMTS band operates at 1920 -2170 MHz. This set of frequencies is sufficiently close to the GSM1800 band that UMTS may be considered part of Band 2. Also, Digital Dividend spectrum includes 790 -862 MHz and will be considered hereinafter as part of Band 1. However, additional bands are being added. For example, LTE2.6 operates at 2.5 -2.7 GHz (Hereinafter "Band 3") and WiMax operates at 3.4 -3.8 GHz (hereinafter "Band 4"). To make use of Bands 3 and 4, wireless communications operators typically replace existing base station antennas with new multiband antennas.

However, simply adding additional cross-polarized radiating elements for Band 3 and Band 4 to a conventional dual band antenna poses certain difficulties. There is limited area for the inclusion of additional radiating elements, because the space between radiating elements of one band is already occupied by radiating elements of another band. Also, the Band 3 and Band 4 elements may introduce undesirable interference and distortion in the operation of the Band 1 and Band 2 elements.

SUMMARY

An object of the present invention is to provide a multiband antenna that includes Band 3 and/or Band 4 capabilities, and has a size comparable to a conventional dual-band antenna, so that it may be installed on existing antenna towers and/or other supports. The multiband antenna should be able to operate in three to four bands, which may be well apart from each other. Another object of the invention is to provide diversity reception for Band 3 and/or Band 4.

A multiband antenna is provided herein. In one example of the invention, the multiband antenna has a longitudinal ground plane and several sets of radiating elements mounted on the ground plane, which may be arrayed in linear arrays. A first set of first radiating elements may be disposed lengthwise along a center of the ground plane. The first radiating elements may be dimensioned to operate in a first frequency band, such as Band 1. As noted above, while Band 1 radiating elements are typically dimensioned to operate at about a frequency range of 880 -960 MHz, the Digital Dividend spectrum, which is at 790 -862 MHz, is considered for the purposes of this invention to be part of this band.

A second set of second radiating elements may also be disposed lengthwise along the center of the ground plane. The second radiating elements may be dimensioned to operate in a second frequency band, such as Band 2. As noted above, while Band 2 radiating elements are typically dimensioned to operate at about frequency range of 1710 -1880 MHZ, the UMTS band, which operates at 1920 -2170 MHz, is considered for the purposes of this invention to be part of this band.

A third band of frequencies is accommodated by third and fourth sets of radiating elements. Instead of being disposed along a center line of the ground plane, the third set of third radiating elements is disposed lengthwise on the ground plane on a first side of the first and second sets of radiating elements. The third radiating elements may be dimensioned to operate at a third frequency band, such as Band 3 or Band 4. The fourth set of fourth radiating elements is disposed lengthwise on the ground plane on a second side of the first and second sets of radiating elements. The fourth radiating elements are also dimensioned to operate in the third frequency band. That is, the third and fourth sets operate in the same band or bands as each other. In one example, the third and fourth radiating elements are dimensioned to operate at a frequency band of about 2.5 -2.7 GHz. In another example, the third and fourth radiating elements are dimensioned to operate at a frequency band of about 3.4 -3.8 GHz.

In one example, the third and fourth radiating elements are directed dipole elements. The directed dipole elements may be of a conventional Yagi style configuration, or a twisted configuration to provide circular polarization. The directed dipoles may be fabricated on a printed circuit board or fabricated from sheet metal, such as the ground plane. In these examples, an entire set of radiating elements may be fabricated as a single unit.

In another example, instead of directed dipole elements, the third and fourth radiating elements comprise +/−45 degree polarized dipole elements. In this example, the longitudinal ground plane may further comprise a center well and first and second outer wells. The first set of first radiating elements and the second set of second radiating elements are disposed in the center well. The third set of third radiating elements is disposed in the first outer well, and the fourth set of fourth radiating elements are disposed in the second outer well. The wells enable use of +/−45 degree polarization on the third and fourth sets of radiating elements without causing undue interference with the first and second sets of radiating elements. The outer wells may be angled inward to adjust performance.

In another example, a four-band antenna is provided. In this example, the multiband antenna further includes a fifth set of fifth radiating elements interspersed with the third radiating elements, the fifth radiating elements being dimensioned to operate at a fourth frequency band, and a sixth set of sixth radiating elements interspersed with the fourth radiating elements, the sixth radiating elements being dimensioned to operate in the fourth frequency band. In this example, the first frequency band comprises about 790-960 MHz, the second frequency band comprises about 1710-2170 MHz, the third frequency band comprises about 2.5-2.7 GHz, and the fourth frequency band comprises about 3.4-3.8 GHz.

DETAILED DESCRIPTION

A multiband antenna, according to one example, includes a ground plane and a plurality of radiating elements. The ground plane may be a single sheet metal stamping.

Figure 1:
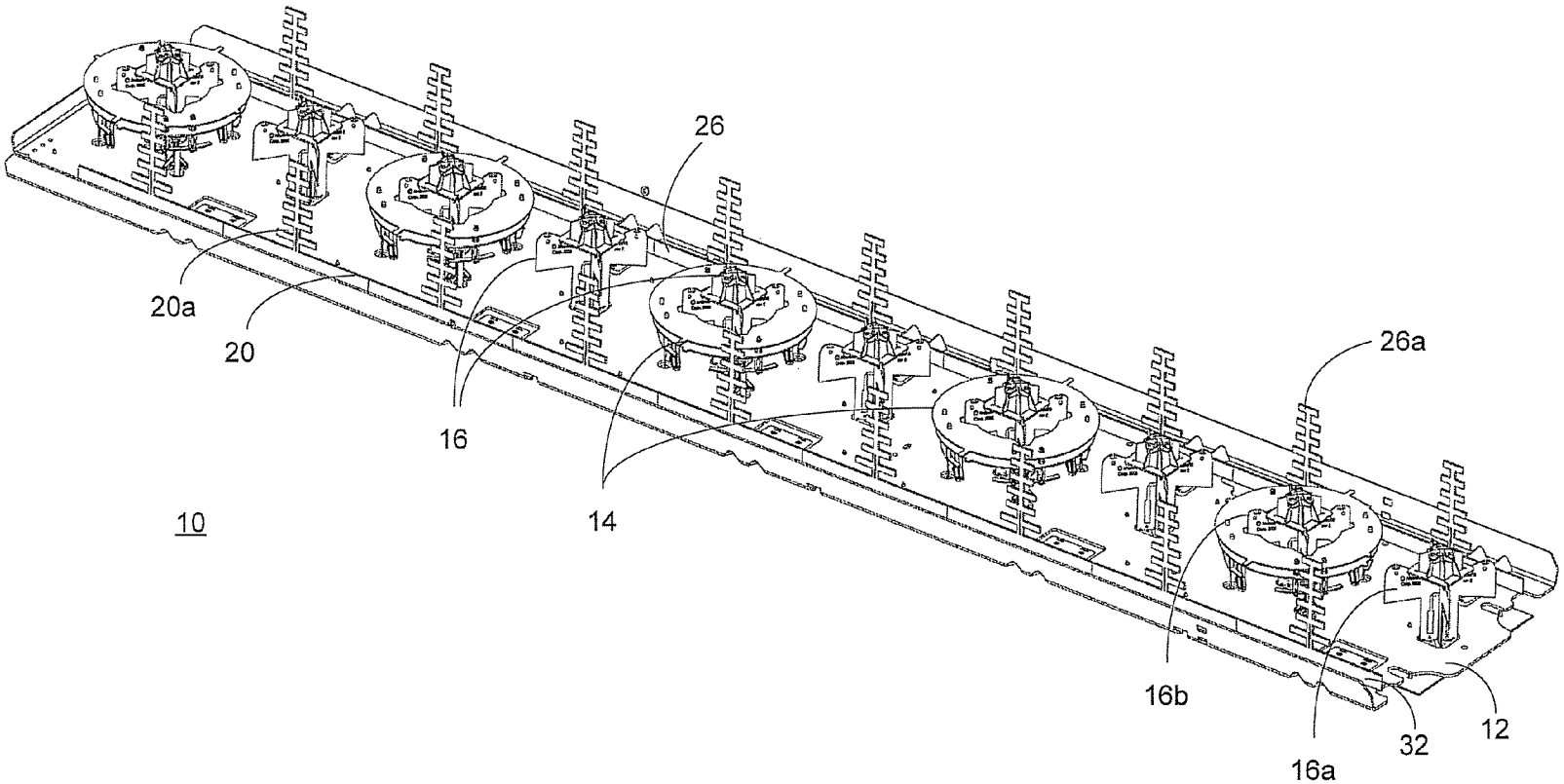
FIG. 1 is a perspective view of a multiband antenna according to a first example of the invention.

Referring to FIG. 1, a first example, a multiband antenna 10 has four sets of radiating elements mounted on a ground plane 12. A first set of radiating elements 14 comprises a first linear array of microstrip annular ring elements 14*a* arranged on a longitudinal axis, approximately in the center of the ground plane 12. The microstrip annular ring elements 14*a* are dimensioned to efficiently transmit and/or receive RF signals in Band 1. In this example, the first set of radiating elements comprises low band elements. The second set of radiating elements 16 comprises a second linear array of crossed dipole elements 16*a*, 16*b*. The crossed dipole elements 16*a*, 16*b* are also arranged in the center of the ground plane 12 on the longitudinal axis approximately in the center of the ground plane 12. The crossed dipole elements are dimensioned for transmission and/or reception of RF signals, in Band 2. The crossed dipole elements 16*a* may be interspersed with the annular ring elements. Additionally, or alternately, the crossed dipole elements 16*b* may be nested within the microstrip annular ring elements. The cross dipole elements may be oriented so that the dipole elements are at approximately +45 degrees to vertical and −45 degrees to vertical to provide polarization diversity reception. The annular ring elements have two ±45 degree polarizations, and may be used to provide polarization diversity, also.

In another example, box dipole elements may be substituted for the crossed dipole elements 16*a*, 16*b*. In another example, box dipole elements may be substituted for the microstrip annular ring elements 14*a*. In another example, dual-polarized patch elements can be used for Band 1 and Band 2 (as in U.S. Pat. No. 6,295,028).

Figure 2A:
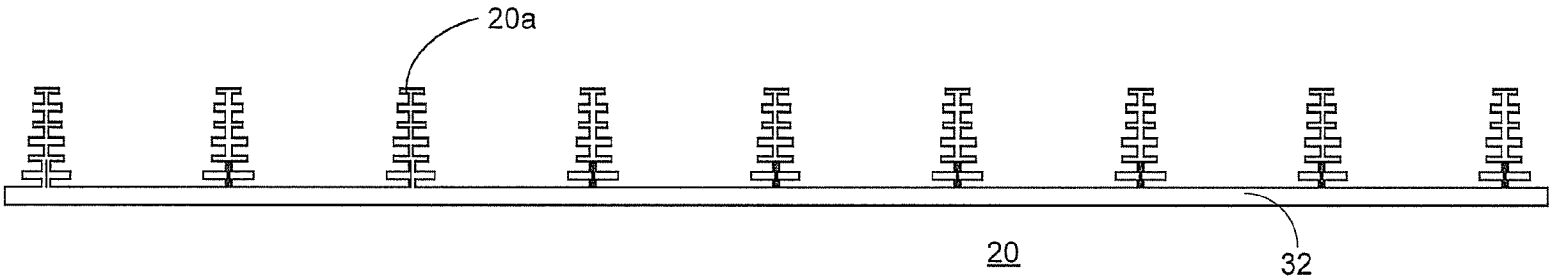
FIG. 2*a* is an array of radiating elements which may be used for Band 3 or Band 4 for radiating elements according to an example of the present invention.
Figure 2B:
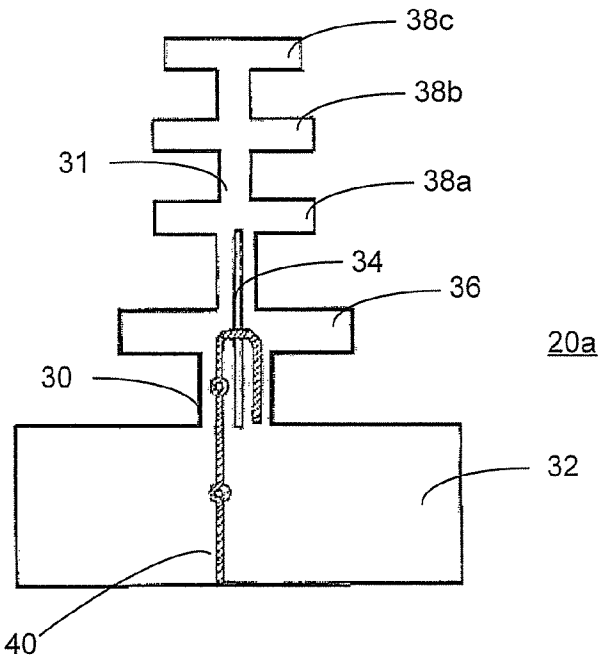
FIG. 2*b* is a directed dipole which may be used in an array of radiating elements according to one aspect of the present invention.

A third set of radiating elements 20 may comprise an array of radiating elements 20*a*. In one example, the third radiating elements 20*a* comprise directed dipole elements. These are commonly known as Yagi-Uda style radiating elements. The third set of radiating elements 20 is located near the outer edge of the ground plane 12. Referring to FIGS. 1, 2*a* and 2*b*, in this example, the third set of radiating elements 20 and the fourth set of radiating elements 26 may be fabricated from sheet metal. The feed network may comprise airstrip conductors on one or both sides of the ground plane 32. See, e.g., FIG. 5. A phase shifter (PCB or airstrip) may also be mounted on the ground plane 12 and coupled to the airstrip feed lines as shown schematically in FIG. 5. An advantage of this example is that no additional supports are necessary for the directors, and the cost of the third and fourth sets of radiating elements is significantly reduced. The third radiating elements 20*a* are dimensioned for transmission and reception of RF signals in Band 3 or Band 4.

Referring to FIG. 2*b*, a close-up view of a radiating element according to one aspect of the present invention is provided. In this example, third radiating element 20*a* comprises a directed dipole, including a dipole support 30 extending from a ground plane 32, and a director support 31 extending further from the dipole support 30. Director support 31 and dipole support 30 further include a 0.5 wavelength balun slot 34. Dipole 36 is supported by the dipole support 30. Dipole 36 is perpendicular to balun slot 34. Additionally, directors 38*a*, 38*b*, 38*c* are supported above the dipole 36 by director support 31. One end of balun slot 34 is near the beginning of director 38*a*, and the other end is near the beginning of ground plane 32. Providing balun slot 34 renders the director support 31 between the dipole 36 and first director 38*a* invisible with respect to RF signals.

Airstrip line 40 is provided to excite the radiating element 20*a*. Airstrip line 40 crosses balun slot 34 near the center of balun slot 34. Airstrip line 40 may be supported off the ground plane 32 and dipole support 30 by plastic supports to provide an air dielectric. The ground plane 32, dipole support 30, director support 31, dipole 36, and directors 38*a*, 38*b*, 38*c* may be fabricated from a single piece of sheet metal. In one example, the third and fourth sets of radiating elements may be formed integrally with ground plane 12. While other fabrication techniques may be used to construct directed dipoles of radiating element 20*a*, the stamped metal example has certain advantageous aspects. All of the components (dipole, directors, supports, ground plane) of many directed dipole elements may be fabricated as a single piece. This saves cost and assembly time.

A fourth set of radiating elements 26 (see FIG. 1) may comprise an array of directed dipole elements arranged along an edge of the ground plane 12 opposite the third set of radiating elements 20. Preferably, the fourth set of radiating elements 26 are fabricated to be the same as the third set of radiating elements 20. In this example, the fourth radiating elements 26*a* are directed dipole elements which are dimensioned to be the same as the third set of radiating elements, and the feed network is equivalent. For example, if the radiating elements 20*a* of third set of radiating elements 20 are dimensioned for transmission and/or reception of RF signals in Band 3, so are the fourth radiating elements 26*a* of the fourth set of radiating elements 26.

In an alternate example (FIG. 10), the third and fourth sets of radiating elements are fabricated on a Printed Circuit Boards (PCB). A feed network may be fabricated on the PCB. The feed network may include variable elements, such as phase shifters, to adjust antenna radiation attributes, such as beam tilt. The feed network may also include a diplexer (e.g., between Band 1 and Band 3 or 4).

The distance between the third set of radiating elements 20 and the fourth set of radiating elements 26 may be in the range of 1.5 to 4 wavelengths of the Band 3 or Band 4 signals to allow for space diversity with correlation coefficient <0.5 and diversity gain >8 dB. See, e.g., Compact Antenna Arrays for MIMO Application, IEEE AP-S 2001, v.3, pp. 708-11. See also, "Encyclopedia for RF and Microwave Engineering, editor Chang, Ky, 2005 (John Wiley & Sons, p. 332). A typical Base station dual-band antenna has a width of about 300 mm. Accordingly, preferably, the third and fourth radiating elements are located near the outer edges of the ground plane 12, to achieve a separation of about 2.2 wavelengths of Band 3.

With Yagi style directed dipole arrays separated by 2-4 wavelengths, 35-40 dB of inter-port isolation is achievable, which is well above the industry specification (>25-30 dB) and a 10-15 dB improvement over regular dipoles. The use of compact space diversity schemes has previously been limited by known regular dipoles. Use of Yagi style elements and vertical polarization (instead of 45 degree slant polarization, as is known) allows to achieve a F/B ratio improvement of 5 dB to 10 dB.

The directed dipole arrangement of the example give above has been found to operate satisfactorily without causing undesirable levels of interference with the first and second sets of radiating elements (e.g., Band 1 and Band 2). Thanks to small electrical size of directed dipole for Band 1, 2. However, in another example, baffles may be included between the Band 1 and Band 2 elements and the Band 3 and/or Band 4 elements. Baffles may improve F/B and symmetry of the radiated pattern.

By adjusting number of directors, azimuth beam width can be adjusted, matching with beam width of Band 1, Band 2. For example, a 65 degree beam requires 3-5 directors.

In another aspect of this example, high directive Yagi style elements (with element pattern of ~60 degree in azimuth and ~45 degree in elevation, which can be achieved with 5-6 directors) elements are used. The high directive elements allow an increase in spacing between elements (up to 1.2 wavelength) and reduces the number of elements required by 30% compared to regular dipole radiating elements. This provides a further cost savings.

Figure 3:
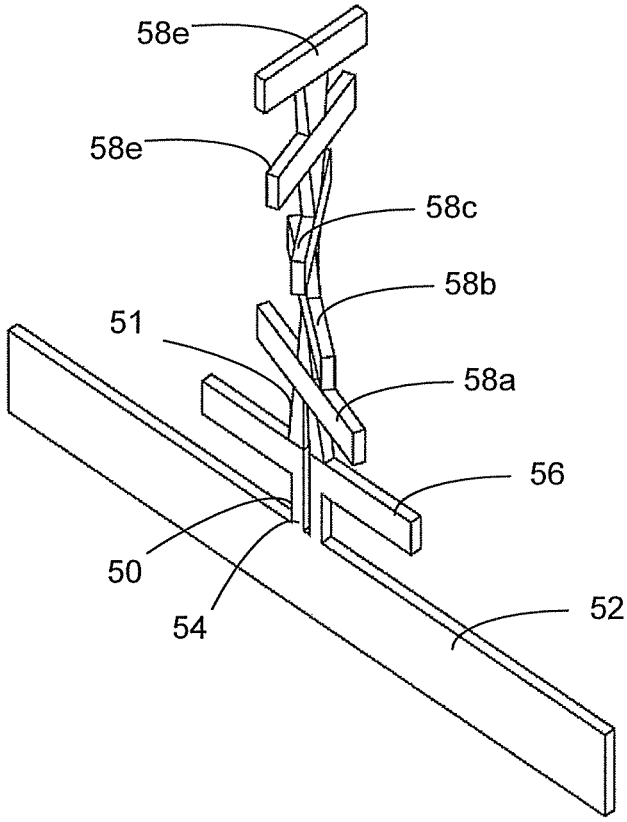
FIG. 3 is an illustration of a circularly polarized directed dipole element in accordance with an alternate example of the invention.
Figure 4:
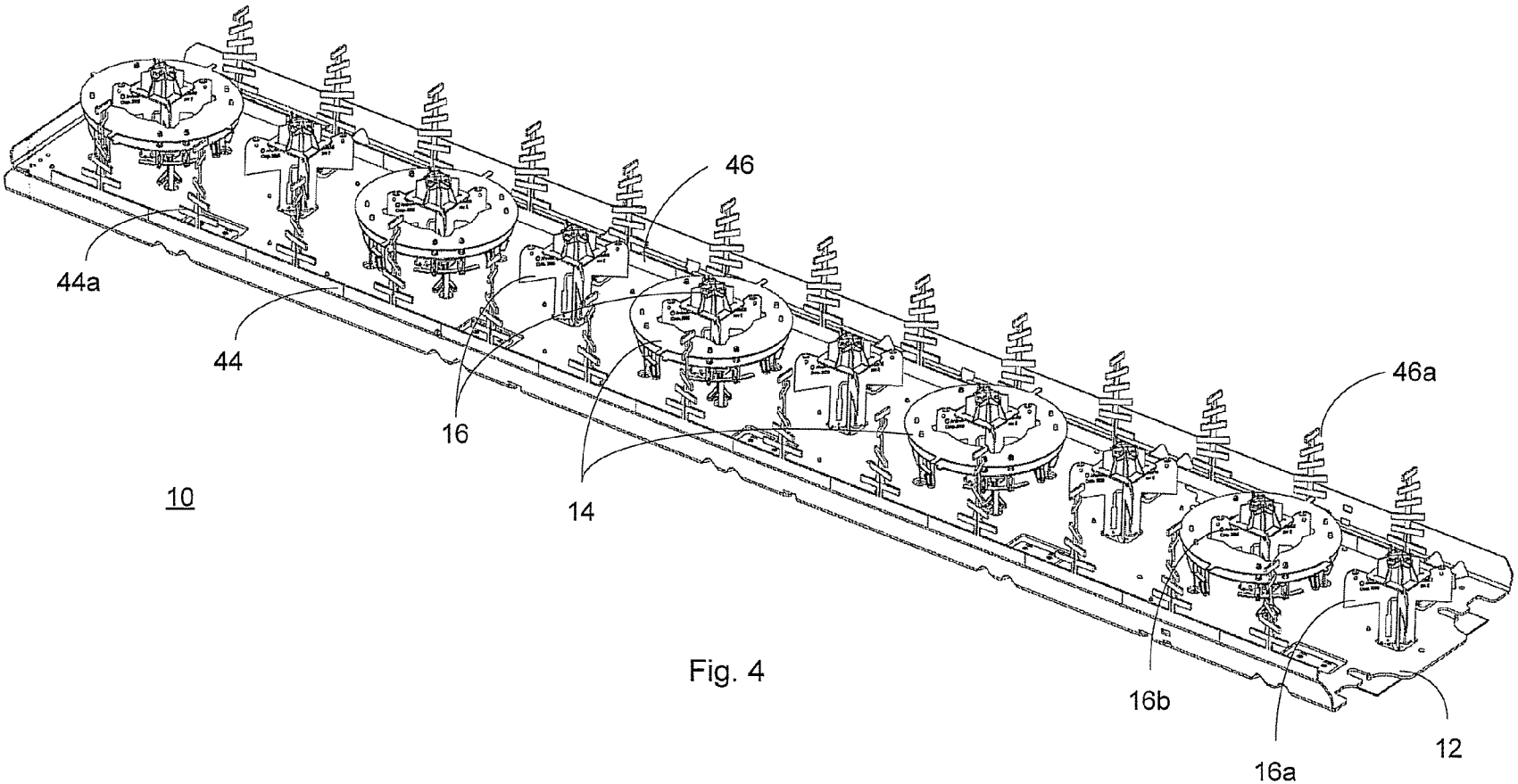
FIG. 4 is a perspective view of a multiband antenna with circular polarization in Band 3 (4).

Referring to FIGS. 3 and 4, in another example, the third and fourth sets of radiating elements may comprise Yagi-style directed elements with circular polarization. Elements 14, 16 in FIG. 4 that are the same as elements in FIG. 1 receive the same reference characters, and the discussion of these elements is not repeated here. Referring to FIG. 3, a radiating element 44*a* is illustrated. Radiating element 44*a* comprises a directed dipole, including a dipole support 50 extending from a ground plane 52, and a director support 51 extending further from the dipole support 50. Director support 51 and dipole support 50 further include a 0.5 wavelength balun slot 54. Dipole 56 is supported by the dipole support 50. Dipole 56 is perpendicular to balun slot 54. Additionally, directors 58*a*, 58*b*, 58*c*, 58*d*, 58*e* are supported above the dipole 56 by director support 51.

In this example, the directors 58*a*, 58*b*, 58*c*, 58*d*, 58*e* are not located in the same plane as the dipole 56 (as in known Yagi antennas) of the radiating elements 44*a*, but are gradually rotated from a vertical position to a horizontal position. Additionally, the directors 58*a*-58*e* may be rotated to achieve orthogonal polarizations for the third and fourth sets of radiating elements 44, 46. For example, the third radiating elements 44*a* may have the directors 58*a*-58*e* rotated to the right (clockwise), while the fourth radiating elements 46*a* may have the directors rotated to the left (counter clockwise). For 2.5-2.7 GHz (7% bandwidth), Left-Handed Circular Polarization and Right-Handed Circular Polarization is achievable with <2 dB axial ratio, as tests have shown. Electrically, these elements are relatively small compared to the Band 1 and Band 2 elements, and do not affect them. The circularly polarized elements may be constructed as elements fabricated from a metal stamping or in accordance with any other examples described herein, e.g., as PCBs or as a single stamping integral with the ground plane 12. The combination of space diversity and polarization diversity leads to very low correlation and good diversity gain. Also, circular polarization is known for good in-building penetration and less mismatch with handsets.

In one example, each director is rotated at an angle $\Theta$ with respect to the immediately preceding director. Director 58*a*, adjacent to the dipole 56, is rotated at an angle $\Theta$ with respect to the dipole 56. The angle $\Theta$ may be constant or variable. The angle $\Theta$ may be in the range of about 5 degrees to 25 degrees. One advantageous example, as illustrated in FIG. 3, illustrates that a circularly polarized directed-dipole element may be fabricated from a single sheet metal stamping. This is in contrast to conventional circular polarization schemes, which involves a quadrature coupler and two sets of orthogonal dipoles.

Figure 5:
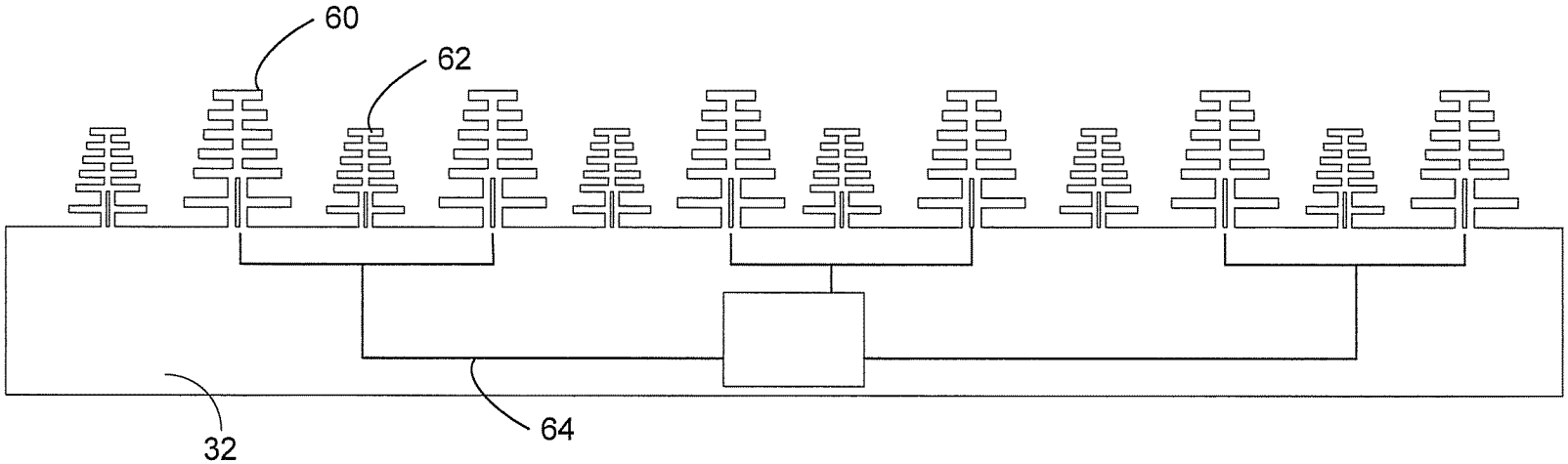
FIG. 5 is an example of Band 3 and Band 4 antenna array, which may be used in a four band antenna according to another example of the present invention.

Referring to FIG. 5, an assembly may include both Band 3 radiating elements 60 and Band 4 radiating elements 62. In this example, including both Band 3 and Band and Band 4 radiating elements 60, 62 means that a fifth set of radiating elements and a sixth set of radiating elements are provided. The third and fourth sets of radiating elements comprise directed dipole elements are dimensioned for efficient transmission and reception of Band 3 RF signals. The radiating elements comprising the fifth and sixth sets of radiating elements are also directed dipole elements, and are dimensioned for efficient transmission and reception of RF signals in Band 4. The fifth set of radiating elements may be interspersed with the third set of radiating elements, and the sixth set of radiating elements may be interspersed with the fourth set of radiating elements. The spacing for each radiating element in each band can be about 100 mm (1.2 wavelength for Band 4 and 0.9 wavelength for Band 3), allowing Band 4 elements to be placed between Band 3 elements. Thanks to narrow element pattern of directed dipole in elevation plane, grating lobes are <−10 dB in Band 3, 4 with beam tilts up to 10°. In this manner, low cost antenna is realized with 8 connectors/ ports, and with width ≤300 mm only. The third, fourth, fifth and sixth sets of radiating elements may comprise any of the configurations and manufacturing techniques described above, e.g., vertically oriented directed dipoles, circularly polarized directed dipoles, and/or PCB radiating elements and feed networks or directed dipoles fabricated in one piece with the ground plane 12. Referring to FIG. 5, an example using directed dipole fabricated integrally with the ground plane is shown. In the illustrated example, the microstrip feed network 64 for the Band 3 elements is shown, but, the microstrip feed network for the Band 4 elements is on the opposite side of the ground plane 32 and is not shown. Diplexers may be integrated in to reduce the number of antenna connectors.

Figure 10:
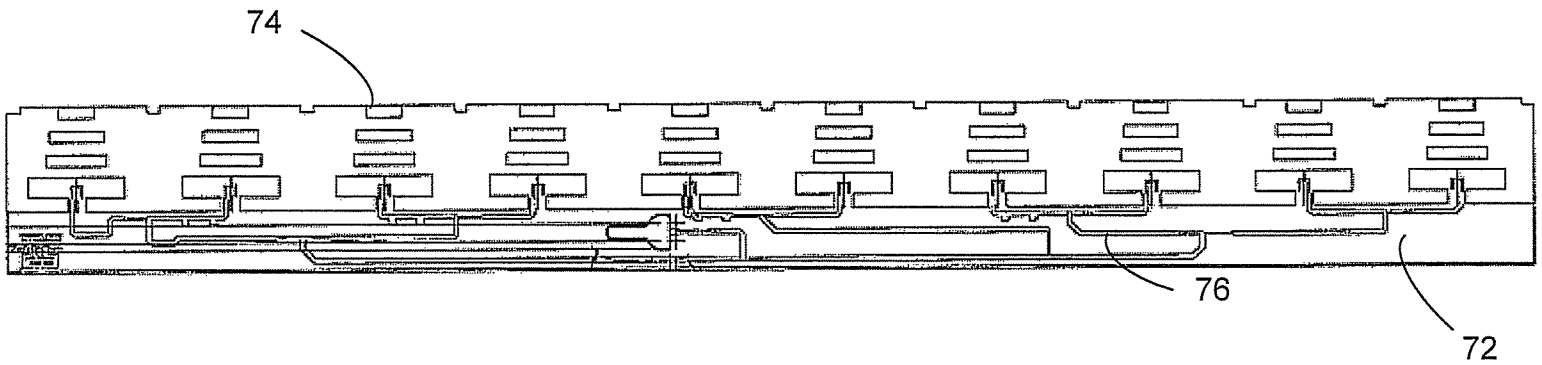
FIG. 10 is Band 3 (or Band 4) antenna array fabricated on printed circuit board.

Referring to FIG. 10, an example of a set of radiating elements 70 suitable for Band 3 or Band 4 is illustrated using Printed Circuit Board (PCB) fabrication techniques. The PCB 72 includes a plurality of directed dipoles 74, which are plated copper on a glass-reinforced plastic substrate. Also illustrated is a feed network 76 for the radiating elements disposed on the PCB.

The above examples provide the following benefits. There is polarization diversity in Band 1 and Band 2, and there is space diversity in Band 3 and/or Band 4. Additionally, in some examples, space diversity is coupled with polarization diversity in Band 3 and/or Band 4. Also, by providing separate feed networks, independent elevation in beam tilt is achieved for all three to four bands. There is the same (for example, 65 degree) azimuth beam width for all four bands, and acceptable front to back ratio for all four bands, due to Yagi style radiators for Band 3, 4, despite of their location on the very edge of the ground plane 12.

Figure 6:
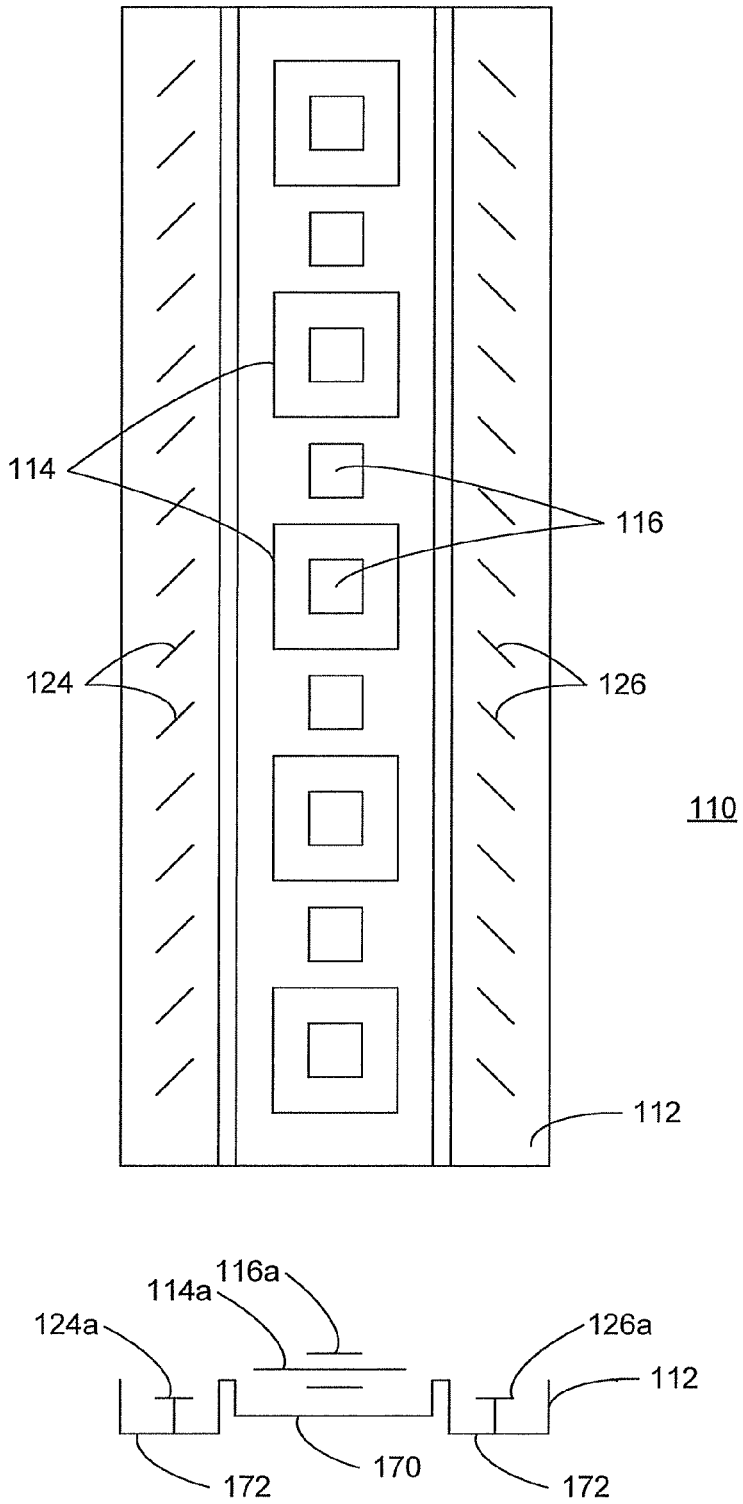
FIG. 6 is a plan and end view of a multiband antenna according to another example of the invention.

In another example, illustrated in multiband antenna 110 in FIG. 6, it may be desired to use conventional slant ±45 polarization for all bands without the use of Yagi-style directed dipoles. In one example of such as multiband antenna 110, a ground plane 112 and a plurality of radiating elements is provided. The ground plane 112 may comprise a center well 170 and a first outer well 172 and a second outer well 172. The ground plane 112 may be a single sheet metal stamping, or the center well 170 and outer wells 172 may be defined by walls or baffles.

Referring to FIG. 6, one example of this embodiment having four sets of radiating elements is illustrated. A first set of radiating elements 114 comprises a first linear array of first patch radiating elements 114*a* arranged on a longitudinal axis, approximately in the center of the ground plane 112. The first patch elements are dimensioned to efficiently transmit and/or receive RF signals in Band 1. The second set of radiating elements 116 comprises a second linear array of second patch elements 116*a*. The second patch elements are also arranged in the center well 170 on the longitudinal axis approximately in the center of the ground plane 112. The second patch elements are dimensioned for transmission and/or reception of RF signals, in Band 2. The second patch elements may be interspersed with the first patch elements. In alternate examples, the second patch elements may be nested within the first patch elements.

In another example, other types of dual polarized radiating elements can be used for Band 1 and 2; for example microstrip annular ring, box dipole, and/or crossed dipoles.

A third set of radiating elements 124 may comprise an array of dipole radiating elements 124*a*, arranged at an angle of +45° to the longitudinal axis of the ground plane 112, and disposed in the first outer well 172. The third set of radiating elements 124 are dimensioned for transmission and reception of RF signals in Band 3 or Band 4.

A fourth set of radiating elements 126 may comprise an array of dipole radiating elements 126*a*, arranged a −45° angle to the longitudinal axis of the ground plane 112, and disposed in the second outer well 172. The dipole elements of the fourth set of radiating elements are dimensioned to be the same as the dipole elements of the third set of radiating elements, only oriented so that the polarization is 90° to the third set of radiating elements. For example, if the dipole elements of third set of radiating elements are dimensioned for transmission and/or reception of RF signals in Band 3, so are the dipole elements of the fourth set of radiating elements. In this example, both polarization diversity (±45 degree) and space diversity (with spacing about 2.2 wavelength) are achieved for Band 3 (or Band 4), providing reduction of correlation coefficient and increasing of diversity gain. The use of the first and second outer wells 172 enables the use of conventional dipole elements at 45 degree slants, without adversely affecting the performance of the Band 1 and Band 2 elements.

Figure 7:
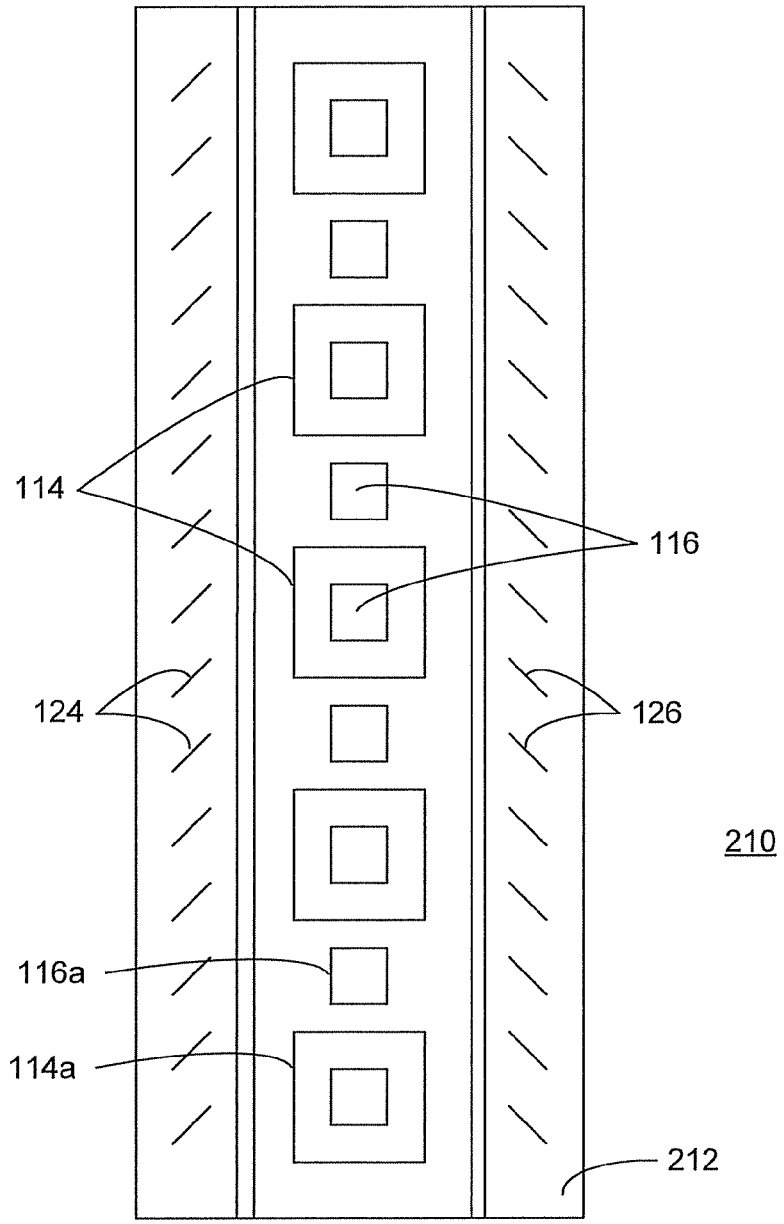
FIG. 7 is a plan and end view of a multiband antenna according to another example of the invention.
Figure 7:
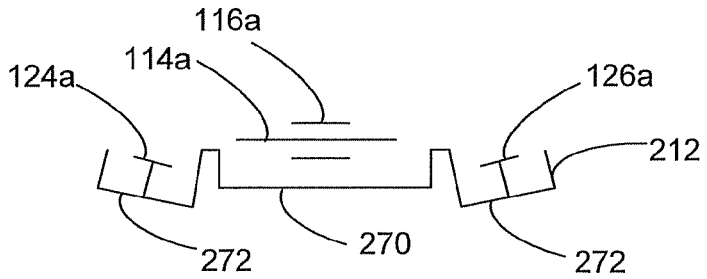

In the example of FIG. 6, the first outer well 172 and the second outer well 172 are approximately parallel with the center well 170. In an alternate example, illustrated in FIG. 7, multiband antenna 2100 is illustrated. In this example, ground plane 212 is formed such that the first and second outer wells 272 are angled inward with respect to center well 270. In this example, rotation of the outer wells 172 improves pattern squint of Band 3 and Band 4 and without degradation of Band 3 (4) radiation pattern due to edge effect. In particular, wells 172 are improving front-to-back and cross-polarization ratios for Band 3 (4).

Figure 8:
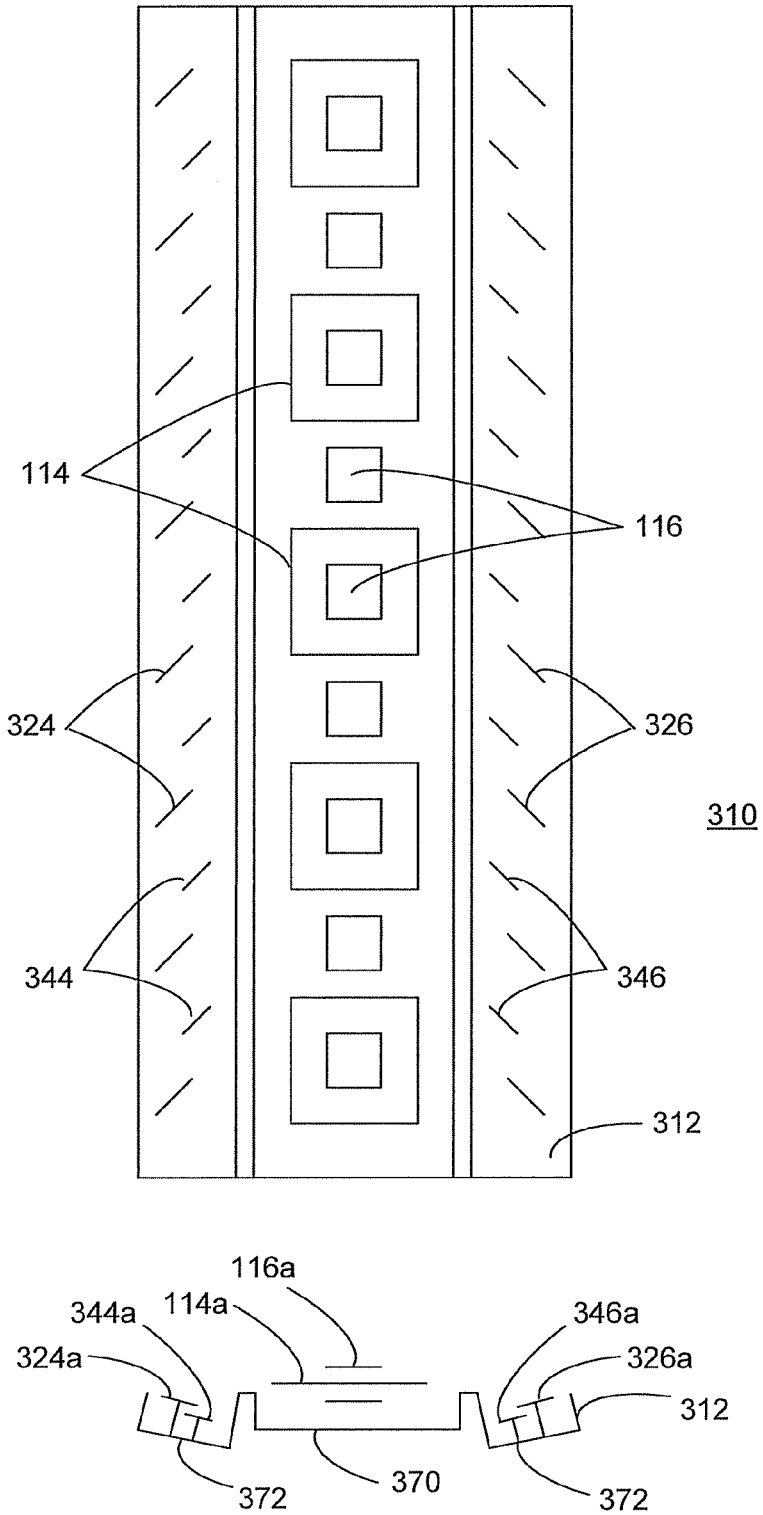
FIG. 8 is a plan and end view of a multiband antenna according to another example of the present invention.

In the examples described above, the radiating elements 124*a* of the third set of radiating elements 124 are disposed on one longitudinal axis, and the radiating elements 126*a* of the fourth set of radiating elements 126 are disposed on another longitudinal axis. In an alternate example, illustrated in FIG. 8, multiband antenna 310 has a center well 370 and outer wells 372. Third set of radiating elements 324 and fifth set of radiating elements 344 are disposed in a first outer well 372, while fourth set of radiating elements 326 and sixth set of radiating elements 346 are disposed in a second outer well 372. In this example, the third and fourth sets of radiating elements 324, 326 are Band 3 radiating elements, and the fifth and sixth sets of radiating elements 344, 346 are Band 4 radiating elements. Directors can be used above dipoles 326, 346 for decreasing interference between them. The radiating elements 324*a* may be staggered with respect to radiating elements 344*a*, and radiating elements 326*a* may be staggered with respect to radiating elements 346*a*, so that they do not share a common axis, and/or may be offset from the center of the outer well 372. In an alternate embodiment, the multiband antenna may have only Band 3 or Band 4 elements, and the radiating elements within a set of radiating elements may be offset with respect to each other. This provides further improvement of beam stability and narrows azimuth beam width to 60-65°.

In another example (not illustrated), the third set of radiating elements comprises an array of box dipole elements disposed in the first outer well. The third set of radiating elements are dimensioned for efficient transmission and reception of RF signals in Band 3. The fourth set of radiating elements comprises an array of box dipole elements disposed in the second outer well. The fourth set of radiating elements are dimensioned for efficient transmission and reception of RF signals in Band 4. In this example, a four-band 8-port antenna is realized. Alternatively, the third set of radiating elements and the fourth set of radiating elements need not be box dipole elements. In one example, the third set of radiating elements may comprise box dipole elements and the fourth set of radiating elements may comprise cross dipole elements. Other combinations of radiating elements are contemplated, including dipole of Band 3 crossed with dipole of Band 4.

Figure 9:
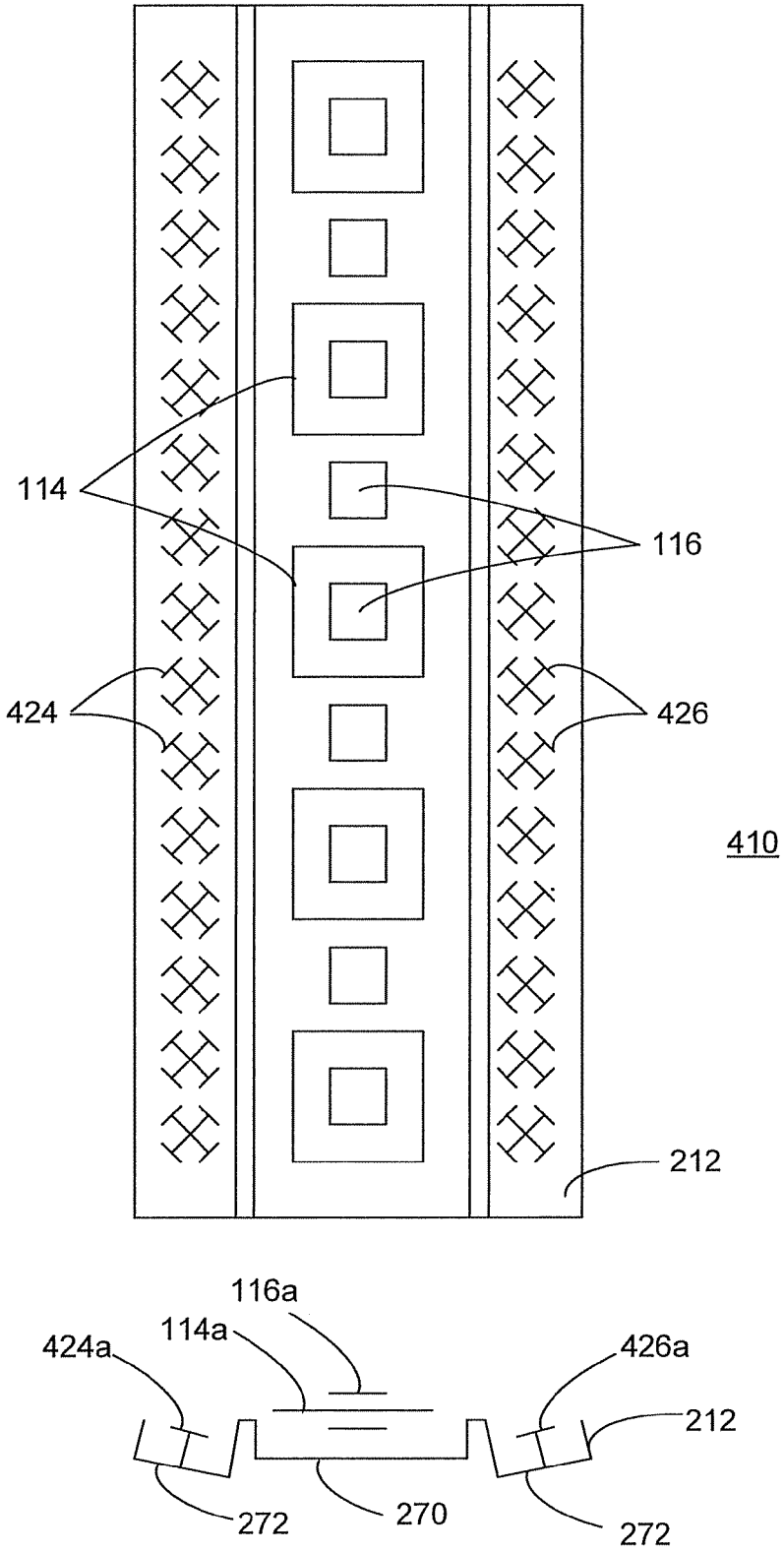
FIG. 9 is a plan and end view of a multiband antenna where all elements are dual polarized.

In another example, referring to FIG. 9, third and forth sets of radiating elements 424, 426 are identical dual polarized arrays of Band 3 (or Band 4) elements. This 3-band antenna has 8 ports (2 ports for Band 1, 2 ports for Band 2, 4 ports for Band 3 (or 4). Radiating elements of third and forth sets 424*a*, 426*a* are located in first and second outer wells 472 respectively, and can be +/−45 polarized cross-dipoles, box dipoles, (as shown in FIG. 9), or patch elements. Due to orthogonally of polarizations and physical separation between these 2 identical arrays, very low correlation coefficient between them is achieved, which benefits to LTE2.6 performance and using of 4×2 and 4×4 multiple-output (MIMO) schemes. Also, placing of 2 identical arrays for the same base station sector increases system capacity and throughput.

Although examples described above are related to wireless communications bands, the proposed solutions can be used for other bands and applications where multiband antennas are required.

What is claimed is:

1. A multiband antenna comprising:

a longitudinal ground plane;

a first set of first dual polarized radiating elements disposed lengthwise along a center of the ground plane, the first radiating elements being dimensioned to operate in a first frequency band;

a second set of second dual polarized radiating elements disposed lengthwise along the center of the ground plane, the second radiating elements being dimensioned to operate in a second frequency band;

a third set of third radiating elements disposed lengthwise on the ground plane on a first side of the first and second sets of radiating elements, the third radiating elements being dimensioned to operate at a third frequency band; and a fourth set of fourth radiating elements disposed lengthwise on the ground plane on a second side of the first and second sets of radiating elements, the fourth radiating elements being dimensioned to operate in the third frequency band.

2. The multiband antenna of claim 1, wherein the first frequency band comprises about 790-960 MHz, the second frequency band comprises about 1710-2170 MHz, and the third frequency band comprises about 2.5-2.7 GHz.

3. The multiband antenna of claim 1, wherein the first frequency band comprises about 790-960 MHz, the second frequency band comprises about 1710-2170 MHz, and the third frequency band comprises about 3.4-3.8 GHz.

4. The multiband antenna of claim 1, wherein the third and fourth radiating elements comprise directed dipole elements.

5. The multiband antenna of claim 1, wherein the third and fourth radiating elements comprise circularly polarized directed dipole elements.

6. The multiband antenna of claim 1, wherein the third and fourth radiating elements are disposed on a printed circuit board.

7. The multiband antenna of claim 6, wherein the printed circuit board further includes a feed network.

8. The multiband antenna of claim 1, wherein the third set of third radiating elements and the fourth set of fourth radiating elements are fabricated from sheet metal.

9. The multiband antenna of claim 1, wherein the third and fourth radiating elements comprise a ground plane, a dipole support extending from the ground plane, a dipole supported by the dipole support, a director support extending from the dipole support, and a plurality of directors extending from the director support, wherein the ground plane, dipole support, dipole, director support, and directors are fabricated from a single piece of sheet metal.

10. The multiband antenna of claim 9, further incorporating a 0.5 wavelength balun slot formed at least in part on the dipole support.

11. The multiband antenna of claim 10, wherein each of the plurality of directors is rotated at an angle $\Theta$ with respect to its immediately preceding director, and a lower most director is rotated at an angle $\Theta$ with respect to the dipole, where $\Theta$ is in the range of about 5 degrees to 25 degrees.

12. The multiband antenna of claim 9, wherein the third radiating elements are fabricated from a single piece of sheet metal to form the third set of radiating elements, and wherein the fourth radiating elements are fabricated from a single piece of sheet metal to form the fourth set of radiating elements.

13. The multiband antenna of claim 1, wherein the third and fourth radiating elements comprise +/−45 degree polarized elements.

14. The multiband antenna of claim 1, wherein the longitudinal ground plane further comprises a center well and first and second outer wells, and wherein the first set of first radiating elements and the second set of second radiating elements are disposed in the center well, and third set of third radiating elements is disposed in the first outer well, and the fourth set of fourth radiating elements are disposed in the second outer well.

15. The multiband antenna of claim 14, wherein the third and fourth radiating elements comprise +/−45 degree polarized dipole elements.

16. The multiband antenna of claim 1, further comprising a fifth set of fifth radiating elements interspersed with the third radiating elements, the fifth radiating elements being dimensioned to operate at a fourth frequency band; and a sixth set of sixth radiating elements interspersed with the fourth radiating elements, the sixth radiating elements being dimensioned to operate in the fourth frequency band.

17. The multiband antenna of claim 16, wherein the first frequency band comprises about 790-960 MHz, the second frequency band comprises about 1710-2170 MHz, the third frequency band comprises about 2.5-2.7 GHz, and the fourth frequency band comprises about 3.4-3.8 GHz.

18. A multiband antenna comprising:

a longitudinal ground plane;

a first set of first radiating elements disposed in a linear array along a center of the ground plane, the first radiating elements being dimensioned to operate in a first frequency band of about 790-960 MHz;

a second set of second radiating elements disposed linear array along the center of the ground plane, the second radiating elements being dimensioned to operate in a second frequency band of about 1710-2170 MHz;

a third set of third radiating elements disposed in a linear array on the ground plane on a first side of the first and second sets of radiating elements, the third radiating elements being directed dipole elements dimensioned to operate at a third frequency band; and a fourth set of fourth radiating elements disposed in a linear array on the ground plane on a second side of the first and second sets of radiating elements, the fourth radiating elements being directed dipole elements dimensioned to operate in the third frequency band.

19. The multiband antenna of claim 18, wherein the third frequency band comprises about 2.5-2.7 GHz.

20. The multiband antenna of claim 18, wherein the third frequency band comprises about 3.4-3.8 GHz.

21. The multiband antenna of claim 18, further comprising a fifth set of fifth radiating elements interspersed with the third radiating elements, the fifth radiating elements being directed dipole elements dimensioned to operate at a fourth frequency band; and a sixth set of sixth radiating elements interspersed with the fourth radiating elements, the sixth radiating elements being directed dipole elements dimensioned to operate in the fourth frequency band, wherein the third frequency band comprises about 2.5-2.7 GHz and the fourth frequency band comprises about 3.4-3.8 GHz.

22. A multiband antenna comprising:

a longitudinal ground plane having a center well, a first outer well, and a second outer well;

a first set of first radiating elements disposed lengthwise in the center well of the ground plane, the first radiating elements being dimensioned to operate in a first frequency band of about 790-960 MHz;

a second set of second radiating elements disposed lengthwise in the center well of the ground plane, the second radiating elements being dimensioned to operate in a second frequency band of about 1710-2170 MHz;

a third set of third radiating elements disposed lengthwise in the first outer well of the ground plane, the third radiating elements being dipole elements dimensioned to operate at a third frequency band and being oriented at +45 degrees to a longitudinal axis of the longitudinal ground plane; and a fourth set of fourth radiating elements disposed lengthwise in the second outer well of the ground plane, the fourth radiating elements being dipole elements dimensioned to operate at the third frequency band and being oriented at −45 degrees to a longitudinal axis of the longitudinal ground plane.

23. The multiband antenna of claim 22, wherein the third frequency band comprises one of about 2.5-2.7 GHz and 3.8 GHz.

24. The multiband antenna of claim 22, wherein the third set of radiating elements are not all disposed on a common lengthwise axis and the fourth set of radiating elements are not all disposed on a common lengthwise axis.

25. The multiband antenna of claim 22, wherein the third radiating elements are dual polarized elements and the fourth radiating elements are dual polarized elements.

26. The multiband antenna of claim 22, further comprising a fifth set of fifth radiating elements interspersed with the third radiating elements in the first outer well, the fifth radiating elements being dimensioned to operate at a fourth frequency band and being oriented at +45 degrees to a longitudinal axis of the ground plane; and a sixth set of sixth dipole radiating elements interspersed with the fourth radiating elements in the second outer well, the sixth radiating elements being dimensioned to operate in the fourth frequency band and being oriented at −45 degrees to a longitudinal axis of the ground plane, wherein the third frequency band comprises about 2.5-2.7 GHz and the fourth frequency band comprises about 3.4-3.8 GHz.

* * * * *